United States Patent [19]

Drancourt

[11] 4,030,636

[45] June 21, 1977

[54] TUBE SQUEEZING DEVICE

[75] Inventor: Claude Drancourt, Grenoble, France

[73] Assignee: Societe Presstub, France

[22] Filed: Mar. 15, 1976

[21] Appl. No.: 666,979

[30] Foreign Application Priority Data

Mar. 14, 1975 France ..... 75.08645

[52] U.S. Cl. ..... 222/102

[51] Int. Cl.[2] ..... B65D 35/28

[58] Field of Search ..... 222/101, 102, 98

[56] References Cited

UNITED STATES PATENTS

| | | | |
|---|---|---|---|
| 1,700,364 | 1/1929 | Bishop et al. | 222/102 |
| 1,842,000 | 3/1932 | Winson | 222/102 |
| 2,875,926 | 3/1959 | Furrer | 222/98 |
| 2,876,934 | 3/1959 | Brim | 222/102 |

*Primary Examiner*—Stanley H. Tollberg
*Assistant Examiner*—Hadd S. Lane
*Attorney, Agent, or Firm*—Raymond A. Robic; Arthur Schwartz; Francis B. Francois

[57] ABSTRACT

Tube squeezing device for deformable tubes of the type containing soft paste, comprising two jaws pivotally connected to each other, each jaw comprising a squeezing cylinder, the tube to be squeezed being held between the two cylinders, and means for providing the rotation of one of the squeezing cylinders thus determining the advancing of the device along the tube. Means being provided for preventing the moving back of the device over the squeezed part of the tube; and further means for providing the disengagement of the tube from the device.

7 Claims, 4 Drawing Figures

TUBE SQUEEZING DEVICE

The present invention relates to a tube squeezing device for squeezing out all the content of a tube.

In particular, the tube squeezing device is adapted to all deformable tubes, including plastic tubes such as containing tooth paste, food products, condiment, polishing and waxing pastes or the like.

The known devices for squeezing out a paste from a tube are provided with switches or keys or with a system of corrugated rollers.

These devices are not generally practical, are cumbersome and necessitate various manipulations and if they permit the total squeezing out of the product of the tubes they do not permit the dosage of small quantities at more or less long intervals of time.

The tube squeezing device of the present invention overcomes the above drawbacks.

According to the present invention the tube squeezing device for deformable tubes of the type containing soft paste comprises two jaws pivotally connected to each other, each jaw comprising a squeezing cylinder, the tube to be squeezed being held between the two cylinders, means for providing the rotation of one of the squeezing cylinders thus determining the advancing of the device along the tube, means preventing the moving back of the device over the squeezed part of the tube, and means providing the disengagement of the tube from the device.

The means preventing the moving back of the device over the squeezed part of the tube may comprise a first pair of semi-circular notches provided in apertures of opposite side plates of the lower jaw and which serve as support for the shaft of the mobile cylinder of the lower jaw. And the means providing the disengagement of the tube from the device may comprise a second pair of semi-circular notches provided in the same apertures of the opposing side plates of the lower jaw.

An embodiment of the present invention will now be described, in a non limitative manner, having reference to the attached drawings wherein.

Figure 1:
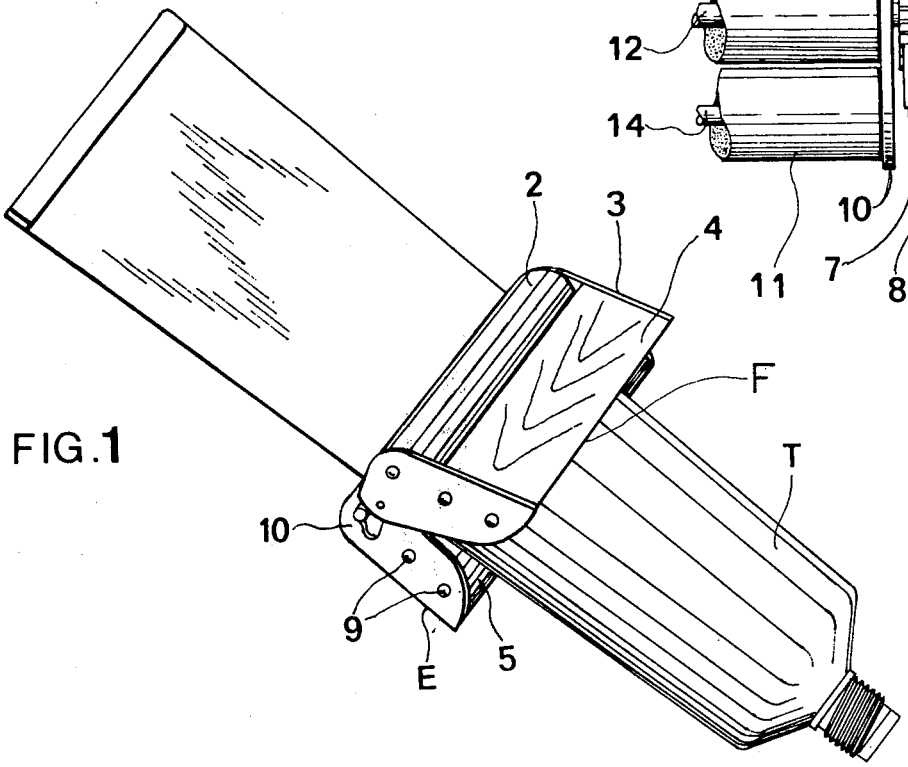
FIG. 1 is a general perspective view of the squeezing device according to the present invention holding a tube.

Referring now to FIG. 1 it is shown a device comprising two jaws E and F pivotally connected to each other and each comprising a squeezing cylinder made of rubber, the tube T to be squeezed being held between the two cylinder 2 and 11.

Figure 2:
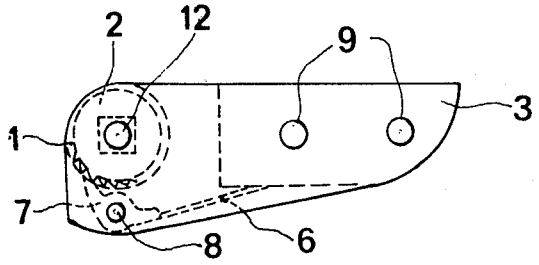
FIG. 2 is a side view of the upper jaw and the corresponding ratchet wheel.
Figure 4:
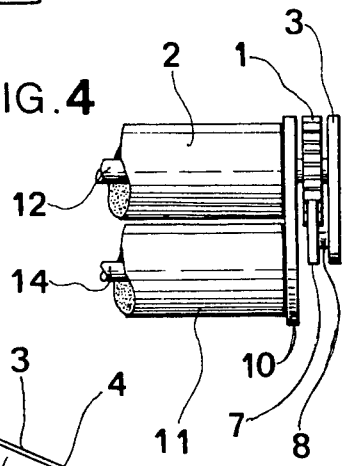
FIG. 4 is a partial front view of the device according to the present invention.

As shown in FIG. 2, the upper jaw F comprises a wooden plate 4 forming a curved edge and having two lateral ends, each end being connected to a side plate 3 by nails or glue, the two side plates serving as a connecting yoke for pivotally connecting and fitting the upper jaw with the lower jaw and also serving as a support for the rotating shaft 12 of the upper rubber cylinder 2 (FIG. 4). The upper jaw F is an encasing jaw partially encasing the lower jaw E which is the encased jaw.

Figure 3:
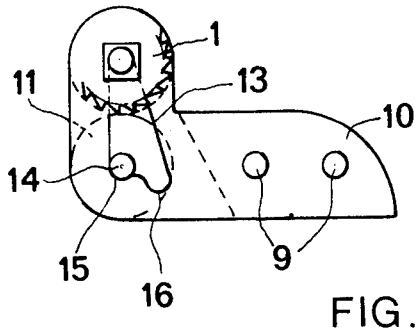
FIG. 3 is a side view of the lower jaw of the device.

In FIG. 3, it is shown the lower jaw E which similarly comprises a wooden plate 5 identical to the plate 4, provided with two lateral side plates 10, nailed to plate 5 at the points 9 or glued thereto and provided with an aperture 13 on each side plate. At the base of each side plate there are provided two semi-circular notches 15 and 16, which serve as support for two positions of the rotating shaft 14 of the lower rubber cylinder 11.

Between the two side plates 3 and 10 of the upper and lower jaws F and E and at one side of the device (see FIGS. 3 and 4) is located a ratchet wheel 1, connected to the shaft 12 of the cylinder 2 by means of a square socket. A pawl 7, pivotally connected to one of the side plates 3 of the upper jaw F by means of a pivot 8 cooperates with the ratchet wheel 1 for driving the cylinder 2 which thus becomes a motor cylinder. The pawl 7 is constantly forced in meshing position with the ratchet wheel by means of a spring leaf 6 held under plate 4 of the upper jaw F.

For inserting a tube in the device, the lower rubber cylinder 11 is placed in the rear position with its shaft 14 in rear notch 15 of the aperture 13, the tube 1 is positioned between the upper and lower jaws F and E at the front of the cylinders 2 and 11, and the device which acts as a clamp is operated to engage the tube. The squeezing exerted on the jaws provides the rotation of the cylinder 2 connected to the ratchet wheel 1 and the pawl 7.

When the shaft 14 is in the first pair of rear notches 15 of the opposing side plates 10, the device is prevented from moving back over the squeezed part of the tube.

For further advancing the device along the tube it is sufficient to raise the plate 4 and the pawl 7 is liberated from the desired number of the teeth of the ratchet wheel and a new squeezing of the device provides again the rotating of the cylinder 2 and so on.

For removing the tube from the device after completely squeezing out the product contained therein, it is sufficient to pull the tube with one hand while retaining the device with the other hand. In doing so, the cylinder 11 is forwardly pulled and its shaft positioned in the second pair of forward notches 16 of the apertures 13 of the opposing side plates 10 thus increasing the gap between the cylinders 2 and 11 and permitting the disengagement and withdrawal of the tube from the device.

It should be noted that in the described embodiment the plates 4 and 5 are made in wood but they could be made in plastic metal or a like material.

The advantages obtained by the present device are numerous:

its use is easy and corresponds to the natural squeezing movement of a tube held in one hand;

it permits the using of the complete product contained in the tube and particularly it provides the precise dosage of the product in small quantities, if desired;

it indicates the quantity of the product remaining in the tube;

it applies to all kind of tubes including those made in plastic material;

the tube thus held between the device may be fixed on a wall or still on a display stand, it may be used to personalize the tube or to receive publicity;

having no switches or keys to be turned, there is no rotational direction to be respected;

its manufacturing cost is low and therefore easily accessible to the public.

I claim:

1. A tube squeezing device for use in manually emptying deformable tubes of the type containing soft paste, comprising:

an upper jaw, including a first, generally horizontal transverse plate engageable by the fingers and having generally vertical, rearwardly extending first end plates on the opposite ends thereof;

a lower jaw, including a second, generally horizontal transverse plate also engageable by the fingers and having generally vertical, rearwardly extending second end plates on the opposite ends thereof, the outer ends of said second end plates each having upwardly extending portions thereon arranged to mesh with the outer ends of said first end plates;

a rotatably mounted first shaft connecting the meshed portions of said first and said second end plates for pivotally connecting said upper and said lower jaws, with said first and said second transverse plates in opposed relationship, the outer ends of said second end plates having aligned apertures therein beneath said first shaft;

a second shaft having its opposite ends received within said aligned apertures;

a first squeezing cylinder received on said rotatable first shaft;

a second squeezing cylinder rotatably carried by said second shaft, and disposed generally below said first squeezing cylinder in opposed relationship;

The space between said upper and said lower jaws being open and unobstructed when said jaws are pivoted apart whereby a tube can be inserted therebetween, with the end thereof in engagement with said first and said second squeezing cylinders; and means operable upon pivotal movement of said upper and lower jaws toward each other to positively rotate said first squeezing cylinder, to thereby laminate between said first and said second cylinders a tube placed between said jaws with the end thereof inserted between said cylinders, said opposed first and second transverse plates being engageable with and exerting pressure on the body of said tube during such pivotal movement of said jaws to thereby squeeze said soft paste out of the tube.

2. A tube squeezing device according to claim 1, wherein the first and second squeezing cylinders are made in rubber.

3. A tube squeezing device according to claim 1, wherein each of said transverse plates and said side plates of each jaw are molded in one piece from plastic material.

4. A tube squeezing device according to claim 1, wherein said transverse plates are made in wood.

5. A tube squeezing device according to claim 1, wherein each pair of said side plates are formed separately from their associated transverse plate, and are secured thereto.

6. A tube squeezing device as recited in claim 1, wherein said aligned apertures in said second end plates extend horizontally and have notches at the opposite ends thereof for seating the ends of said second shaft, the notches nearest the outer ends of said rearwardly extending second end plates being disposed generally beneath said first shaft and seating said second shaft during laminating of a tube, and the notches nearest the second transverse member being spaced further from said first shaft than said first mentioned notches, whereby when said second shaft is moved to said notches nearest said second transverse member a tube received between said squeezing cylinders is released.

7. A tube squeezing device as recited in claim 1, wherein said means operable to positively rotate said first squeezing cylinder includes:

a ratchet wheel fixed on said first shaft; and a pawl carried by said upper jaw and engageable with said ratchet wheel, said first squeezing cylinder being fixed to said first shaft.

* * * * *